US007225605B2

(12) United States Patent
Wüst et al.

(10) Patent No.: US 7,225,605 B2
(45) Date of Patent: Jun. 5, 2007

(54) MODULAR AIR SPINNING FRAME

(75) Inventors: Olivier Wüst, Seuzach (CH); Herbert Stalder, Kollbrunn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 437 days.

(21) Appl. No.: 10/697,707

(22) Filed: Oct. 30, 2003

(65) Prior Publication Data

US 2004/0226278 A1 Nov. 18, 2004

(30) Foreign Application Priority Data

Nov. 20, 2002 (CH) ..... 1947/02

(51) Int. Cl.
*D01H 4/00* (2006.01)

(52) U.S. Cl. ..... 57/400

(58) Field of Classification Search ..... 57/400–417; 242/484.6, 486.6

See application file for complete search history.

(56) References Cited

U.S. PATENT DOCUMENTS

| | | | | |
|---|---|---|---|---|
| 3,990,219 | A | 11/1976 | Schewe | |
| 4,844,358 | A | 7/1989 | Kamp | |
| 5,509,261 | A * | 4/1996 | Wassenhoven et al. | 57/263 |
| 5,927,062 | A | 7/1999 | Deno et al. | |
| 2002/0073683 | A1 | 6/2002 | Zipperer | |

FOREIGN PATENT DOCUMENTS

| | | | |
|---|---|---|---|
| DE | 3623370 | A1 | 1/1987 |
| DE | 3931463 | A1 | 4/1990 |
| DE | 4219701 | A1 | 1/1993 |
| DE | 4212701 | C1 | 5/1993 |
| DE | 19705810 | A1 | 8/1998 |
| EP | 0628647 | A1 | 12/1994 |
| EP | 1188850 | A2 | 3/2002 |

OTHER PUBLICATIONS

EPO Search Report, Oct. 14, 2003.

* cited by examiner

*Primary Examiner*—Shaun R. Hurley
(74) *Attorney, Agent, or Firm*—Dority & Manning

(57) ABSTRACT

The invention relates to textile machines with several spinning places, whereby each spinning place comprises a can feeding means, a spinning unit, and winding unit. The invention is based on the task to design the spinning places in such a manner, to minimize the downtimes due to failures of machine components, or during re-fitting. According to the invention, such a spinning place is furnished with modularly structured and exchangeable spinning units and or winding units.

32 Claims, 1 Drawing Sheet

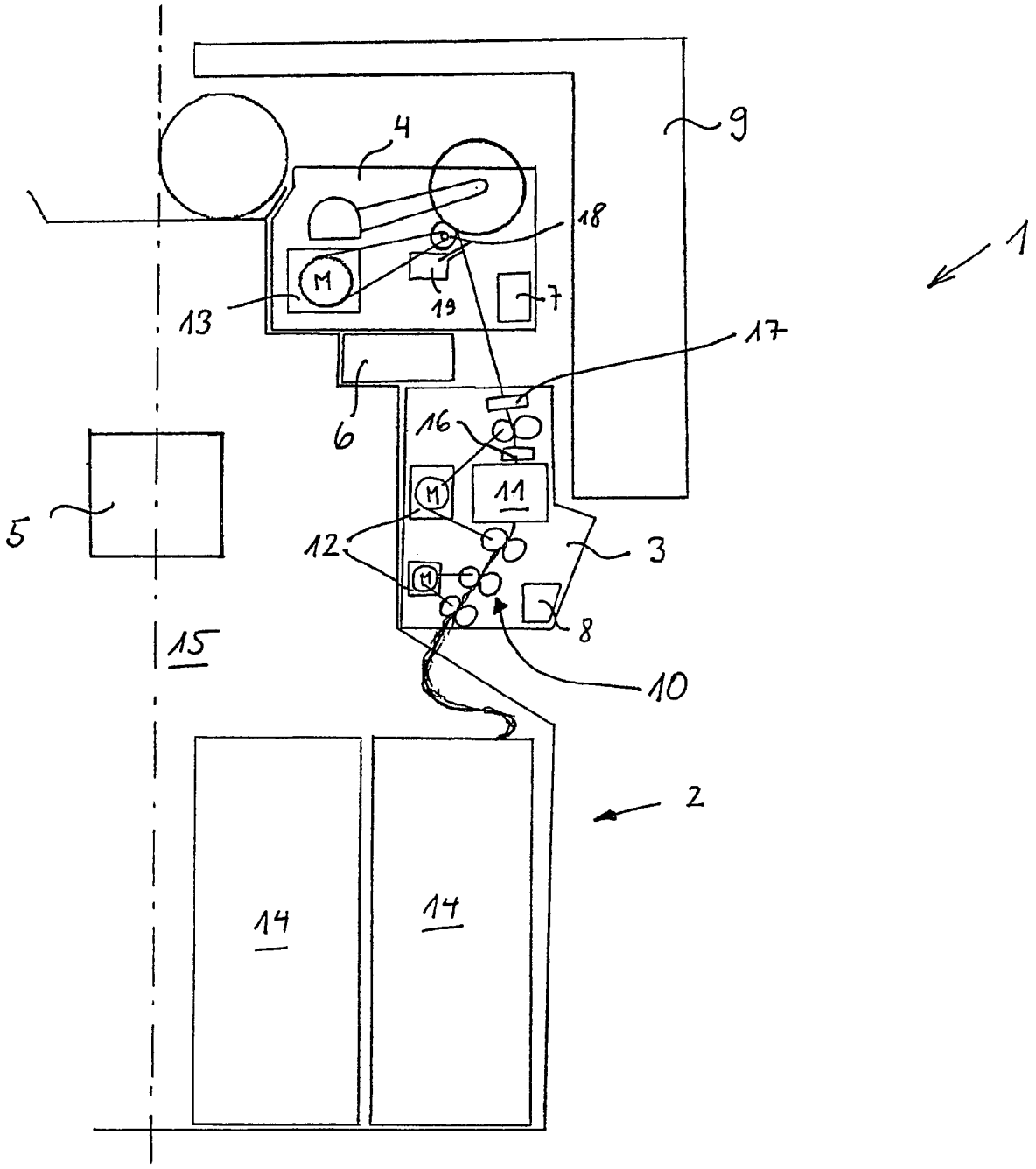
4
9
18
1
13
19
7
17
6
16
5
11
12
3
8
15
10
2
14
14

MODULAR AIR SPINNING FRAME

BACKGROUND OF THE INVENTION

The present invention relates to a textile machine with several spinning places as well as different devices provided thereto.

Such devices are well known in textile technology. Such a device is described, for example, in the DE 42 12 701 C2. This document discloses a rotor spinning frame with a multiplicity of spinning places arranged next to each other, whereby each spinning place comprises a can feeding means, a spinning unit, and a winding device.

A disadvantage of a device according to the afore specified patent specification is, that in case of failures in the spinning unit or on the winding unit, the entire spinning place is put out of operation.

The disclosed application DE 36 24 904 A 1 presents a generic different type of textile machine, that is, a cross bobbin winder that, according to a modular concept, consists of pre-assembled structural units. This cross bobbin winder can be re-fitted with the utilization of several standardized and pre-assembled structural units to create different types of the cross bobbin winder. According to this state of the art, each structural unit or each structural group of components possesses, for the reciprocal position-accurate interconnection, prepared fastening means, position fixing means, and/or couplings for power conducting means. The modular concept is, therefore, known for cross bobbin winders. Cross bobbin winders perform a rewinding procedure which is substantially simpler than the spinning process in a spinning place, because the winding frame operates, contrary to the spinning frames, with a coherent, continuous thread. In the generic different texturing machines, for example, according to the DE 36 23 370 A 1 and DE 197 05 810 A 1, it is likewise known, to provide several modules for the machine. Contrary to spinning frames, texturing machines also operate with continuous and above all flexible filaments.

OBJECTS AND SUMMARY OF THE INVENTION

It is, therefore, a principal task of the present invention to arrange the spinning places in such a manner that downtimes due to failures of machine components of the spinning place or during re-fitting of the spinning place are minimized. Additional objects and advantages of the invention will be set forth in part in the following description, or may be obvious from the description, or may be learned through practice of the invention.

This principal task of the invention is solved by the spinning units and/or the winding units of a spinning machine being modular structures and exchangeable.

With the use of modularly structured and exchangeable spinning or winding units, it is possible, during failures, and/or breakdowns of the devices mentioned, to interchange these simply and fast. With the replaceability of these spinning or winding units, the downtimes are substantially reduced during such occurrences. The modularly structured and exchangeable spinning or winding units have, in addition, still a further advantage. Owing to the modular concept, one can produce thread with different spinning methods on the same textile machine. A spinning frame with such a modular concept is therefore applicable in many ways. Spinning places can produce different thread at the same time on the same machine. For example, thread that is produced with an air spinning method and thread that is produced with a rotor spinning method. Owing to the modular concept and the replaceability of these spinning units, one can refit the spinning places very fast, and thus, produce threads faster and more flexibly, according to customer requests. Such a textile machine, therefore, not only has lower downtimes, but also provides greater flexibility and lower cost of investment. The use of exchangeable winding units, in addition, has the advantage that different types of windings can be produced, and/or different types of bobbins can be used. In the following, the invention and the inventive thought are explained by way of an exemplified embodiment illustrated in the FIGURE. It is, however, to be pointed out expressly that the invention is not limited to this example.

BRIEF DESCRIPTION OF THE DRAWING

FIG. 1 shows a cross-sectional schematic view of a spinning place of a textile machine with a modularly structured and exchangeable spinning unit and winding unit.

DETAILED DESCRIPTION

Reference will now be made in detail to the presently preferred embodiments of the invention, one or more examples of which are shown in the FIGURES. Each example is provided to explain the invention and not as a limitation of the invention. In fact, features illustrated or described as part of one embodiment can be used with another embodiment to yield still a FIG. 1 shows schematically (in the cross section) a spinning place of a textile machine 1. The textile machine 1 is double-sided, whereby the FIGURE shows only one side of the machine (the dash-dotted line shows the axis of mirror inversion of the textile machine 1). Naturally, it would also be conceivable that the textile machine 1, shown in the FIGURE, is designed only one-sided. The spinning places of the textile machine 1 comprise a can feeding means, or can feeding device, 2. The can feeding means, or can feeding device, 2 can take up one or, as is illustrated in the FIGURE, two cans 14. For the invention, it is thereby irrelevant whether one or more cans 14 are present and whether the can feeding means 2 is arranged within, next to, or in front of the spinning place. It would be also conceivable that one can feeding means 2 supplies several spinning units 3, and/or several spinning places with roving. This means that the invention covers the possibility that a can feeding means 2 supplies several spinning places (for example two) with fibre material.

Typically, a spinning place comprises one spinning unit 3 and one winding unit 4. According to the invention, the spinning unit 3 and the winding unit 4 are modular structures and exchangeable (illustrated schematically in the FIGURE). The term "modular" in the sense of the invention is to be understood in such a manner that these units form self-supporting, structural units, assembled from single components, which can be attached on, into, or at a textile machine frame 15 of the textile machine 1. By means of plug-in connections (not illustrated), the spinning units 3 and the winding units 4 can, as far as this is necessary, be supplied with electric power and compressed air from the machine frame 15, as well as with control signals from a central machine control unit 5. The modular concept of the units 3 and 4 also allows different spinning or winding units to be mounted on the same textile machine frame 15. For example, different spinning units 3 can be provided that, with regard to the applied spinning method, and/or thread formation method, comprise different spinning boxes 11. For example, on the same textile machine frame 15, single spinning units 3 can comprise spinning boxes 11, which produce thread according to the air spinning method and other spinning units 3 can comprise spinning boxes 11, which produce thread according to a rotor spinning method. For this, the textile machine frame 15 must be equipped with suitable connections for electrical power and compressed air as well as for exhaust air (not shown). Besides a central control unit 5, it is advantageous if the spinning unit 3 and the winding unit 4 are additionally interconnected through an exchangeable control unit 6. The exchangeable control unit 6 takes over the controlling of the individual spinning places. The control unit 6 especially controls and monitors the thread formation process on the spinning unit 3 and the transfer of the produced thread to the winding unit 4. The exchangeable control unit 6 is, in particular, able to consider the different delivery speeds of the different spinning units 3 for the winding unit 4. That means, it is, in particular, able to control the delivery speeds, and/or production speeds, of the spinning units 3 and winding units 4. Naturally, also the central machine control unit 5 can likewise be connected with the exchangeable control units 6 of the individual spinning places. Thus, control signals, for example given by the operating personnel, can be delivered, from the central machine control unit 5 through the exchangeable control units 6 of the individual spinning places, to the individual machine units (spinning or winding units). Such control signals that are delivered through the central control unit 5 are, for example, the start and stop of the entire spinning frame or the draft of the refinement units (drafting units) of the spinning units.

Furthermore, it is likewise provided that the spinning unit 3 or also the winding unit 4 may include individual control means 7 and 8 specific to that unit. These provide for the implementation of the received control signals on the actually present machine units (for example, at the spinning unit 3 the controlling of the motors of a drive unit 12 or of the spinning box 1). The control means of the spinning unit 3, in particular, has to control a controlled starting up and switching off of the whole spinning unit 3. For this, a certain procedure can be provided.

In a preferred embodiment of the invention, the textile machine in each spinning place or for each spinning place comprises one robot, which respectively is also a modular structure that is exchangeable in the sense of the preceding concept. During a machine stop, the robot 9, by means of an auxiliary thread, accomplishes a start up of spinning or, if there is a thread break, joins the thread end of the bobbin with the new thread (piecing). It is also conceivable that the robot 9 serves several spinning places (with the help of a not illustrated device for moving).

Preferably, the spinning units 3, in addition, comprise a refinement unit 10. The refinement unit 10 illustrated in the FIGURE represents a drafting unit. It would, however, also be conceivable that, in place of the drafting unit 10, a dissolving roller is provided. Whether a refinement unit is used and which type, depends, in particular, on the succeeding spinning method applied in the spinning box 11. If the thread formation method is a rotor spinning method, then preferably a dissolving roller is used as a refinement unit. The actual thread formation process in the spinning unit 3 is performed in the spinning box 11. Preferentially, the modularly structured and exchangeable spinning unit 3 comprises a spinning box that produces a thread according to the air spinning method. In addition, the invention is, however, also suitable in that different spinning units 3 can be applied with different spinning boxes 11. Thus, the spinning boxes 11 can, for example, produce thread according to a rotor spinning method, a friction spinning method, or also according to a false twist method.

The spinning unit 3 can also comprise a yam sensor 16 and a thread sensor 17. As is illustrated in the FIGURE, the spinning unit 3 and the winding unit 4 preferably also comprise their separate individual units 12 and/or 13. The spinning units and/or the winding units are, thus, independent with respect to the drives. They only receive electrical power and controls signals-if necessary also compressed air-through not shown plug-in connections and lines of the textile machine frame 15, and/or from the central machine control unit 5, and/or from the control unit 6 of the spinning place. The exchangeable units 3 and 4 thus comprise, for the substantial process steps, their own drive units 12 and 13 and are not attached, by means of mechanical couplings, to a central drive unit that would be positioned on the textile machine frame 15. The winding at the winding unit 4 that comprises a drive unit 13 for the friction roller 18 belongs to the substantial process steps, which comprise their own drive units. The refinement in the refinement unit (in the exemplified embodiment according to the FIGURE, a drafting unit) and the draw-off from the spinning box belongs to the substantial process steps at the spinning unit 3. The spinning unit 3, therefore, has two individual drive units 12 for the rollers of the drafting unit and for the pair of draw-off rollers. The drives are preferably reluctance motors; however, further asynchronous motors could also be used. It is quite conceivable that for less important process steps, several units are provided with one common drive unit. For example, several winding units 4 can comprise a common drive unit for the traversing device 19 (mechanical force transmission by means of a shaft). As mentioned, the refinement in the refinement unit 10 (drive units 12) as well as in the draw-off of the spinning unit 3 or the drive 13 of the friction roller 18 in the winding unit 4 belong to the most important process steps, which comprise individual drive units or motors. Depending on which type of spinning box 11 is used, the spinning unit 3 can possess yet another further drive unit (not shown) for the spinning box 11 (for example, for the rotor spinning method). The use of individual drives for each unit—in particular for the substantial process steps—has several advantages. For example, no mechanical couplings, power transmissions, or gear transmissions are required. Thus, the individual spinning places are flexible and/or individually adjustable. The speed ratios can be adapted electrically, e.g., more easily (e.g., the draft in the refinement unit or the draw-off speed of the thread out of the spinning box). A synchronization of the drive units in the spinning place can—if it should be necessary—be accomplished with the help of the control means 5 and/or 6. With the help of the separate individual drives, it is also simpler with respect to the drives to run different spinning places and/or spinning units on the same textile machine frame at the same time.

The invention is particularly suitable for spinning units, which produce thread with an air spinning method. With this method, the thread formation takes place through air twisting. For this, the spinning box comprises in each case a fibre conveying channel with a fibre guide surface for guiding the staple fibre strand, at whose outlet a turbulence chamber is provided that, for its part, comprises a spindle with a thread guiding channel. The turbulence chamber contains a fluid device, which generates a turbulence stream (air) around the inlet opening of the thread guiding channel of the spindle. The fibre strand and/or the thread are drawn off by the thread-guiding channel. The turbulence stream around the inlet opening of the thread guiding channel causes a twisting of the outer fibres of the staple fibre strand around its internal core during the drawing off of the longitudinal fibre formation. This way a thread is being produced from a staple fibre strand. Such a method is, for example, disclosed in the patent document EP 854,214 (equivalent to U.S. Pat. No. 5,927,062).

The invention is not limited to the embodiment according to the FIGURE. This embodiment is rather meant as suggestion for the specialist, in order to realize the idea of the invention in a most favorable way. Further, favorable applications and combinations are, therefore, easily derivable that likewise resemble the idea of the invention and that are to be protected by this application. Some of the disclosed features in this description were described combined and are claimed combined in the following claims. It is, however, also conceivable, in application of the invention to claim individual features of this description on their own or in another combination. Therefore, the applicant expressly reserves the right, if necessary, to apply different combinations in the application of the idea of the invention. It will be appreciated by those skilled in the art that various modifications and variations can be made in the present invention without departing from the scope of the invention. It is intended that the present invention include such modifications and variations as come within the scope of the appended claims and their equivalents.

The invention claimed is:

1. A textile machine for spinning fiber material into thread, said textile machine comprising:

a plurality of spinning places with each of said plurality of spinning places including:

a. a can feeding device configured for receiving of cans having said fiber material disposed therein;

b. a modularly structured, exchangeable spinning unit positioned proximal to said can feeding device, said spinning unit configured to be removable from said spinning place and interchangeable with other of said modularly structured, exchangeable spinning units; and c. a winding unit positioned proximal to said spinning unit, said winding unit configured to wind thread being produced by said spinning unit onto a package.

2. A textile machine as in claim 1, further comprising a central machine control unit in communication with each of said plurality of spinning places.

3. A textile machine as in claim 1, wherein each spinning place further comprises a modularly structured, exchangeable control unit in communication with at least one of said spinning unit or said winding unit.

4. A textile machine as in claim 1, wherein each spinning place further comprises at least one individual control unit operably connected to at least one of said spinning unit or said winding unit.

5. A textile machine as in claim 1, wherein each spinning place further comprises a modularly structured and exchangeable robot for start up and piecing of spinning in said spinning unit.

6. A textile machine as in claim 1, wherein each of said spinning units includes a refinement unit comprising at least one of a drafting unit or an opening roller.

7. A textile machine as in claim 1, wherein each of said spinning units includes a spinning box that produces a thread according to one of a rotor spinning method, an air spinning method, a friction spinning method, or a false twist spinning method.

8. A textile machine as in claim 1, wherein each of said spinning units is driven by a corresponding drive unit having at least one motor.

9. A textile machine as in claim 8, wherein said at least one motor comprises a reluctance motor.

10. A textile machine for spinning fiber material into thread, said textile machine comprising:

a plurality of spinning places with each of said plurality of spinning places including:

a. a can feeding device configured for the receiving of cans having said fiber material disposed therein;

b. a spinning unit positioned proximal to said can feeding device, said spinning unit configured for receiving said fiber material from said cans and spinning said fiber material into said thread; and c. a modularly structured, exchangeable winding unit configured to wind said thread produced by said spinning unit positioned proximal to said spinning unit, said winding unit being removable from said spinning place and interchangeable with other of said modularly structured, exchangeable winding units.

11. A textile machine as in claim 10, further comprising a central machine control unit in communication with each of said plurality of spinning places.

12. A textile machine as in claim 10, wherein each spinning place further comprises a modularly structured, exchangeable control unit in communication with at least one of said spinning unit or said winding unit.

13. A textile machine as in claim 10, wherein each spinning place further comprises at least one individual control unit operably connected to at least one of said spinning unit or said winding unit.

14. A textile machine as in claim 10, wherein each of said winding units is driven by a corresponding drive unit having at least one motor.

15. A textile machine as in claim 14, wherein said at least one motor comprises a reluctance motor.

16. A textile machine for spinning fiber material into thread, said textile machine comprising:

a plurality of spinning places with each of said plurality of spinning places including:

a. a can feeding device configured for the receiving of cans having said fiber material disposed therein;

b. a modularly structured, exchangeable spinning unit configured to spin said fiber material into said thread positioned proximal to said can feeding device, said spinning unit configured to be removable from said spinning place and interchangeable with other of said modularly structured, exchangeable spinning units; and c. a modularly structured, exchangeable winding unit configured for winding said thread produced by said spinning unit positioned proximal to said spinning unit, said winding unit configured to be removable from said spinning place and interchangeable with other of said modularly structured, exchangeable winding units.

17. A textile machine as in claim 16, further comprising a central machine control unit in communication with each of said plurality of spinning places.

18. A textile machine as in claim 16, wherein each spinning place further comprises a modularly structured, exchangeable control unit in communication with at least one of said spinning unit or said winding unit.

19. A textile machine as in claim 16, wherein each spinning place further comprises at least one individual control unit operably connected to at least one of said spinning unit or said winding unit.

20. A textile machine as in claim 16, wherein each spinning place further comprises a modularly structured and exchangeable robot for start up and piecing of spinning in said spinning unit.

21. A textile machine as in claim 16, wherein each of said spinning units includes a refinement unit comprising at least one of a drafting unit or an opening roller.

22. A textile machine as in claim 16, wherein each of said spinning units includes a spinning box that produces a thread according to one of a rotor spinning method, an air spinning method, a friction spinning method, or a false twist spinning method.

23. A textile machine as in claim 16, wherein each of said spinning units is driven by a corresponding drive unit having at least one motor.

24. A textile machine as in claim 23, wherein said at least one motor comprises a reluctance motor.

25. A textile machine as in claim 16, wherein each of said winding units is driven by a corresponding drive unit having at least one motor.

26. A textile machine as in claim 25, wherein said at least one motor comprises a reluctance motor.

27. An apparatus for use in a spinning place of a textile machine, said apparatus comprising a modularly structured, exchangeable winding unit for winding thread produced within said spinning place, said winding unit being positionable in and removable from said spinning place and said winding unit being interchangeable with other of said modularly structured, exchangeable winding units.

28. An apparatus for use in a spinning place of a textile machine, said apparatus comprising a modularly structured, exchangeable spinning unit for spinning fiber material into a thread, said spinning unit being positionable in and removable from said spinning place and said spinning unit being interchangeable with other of said modularly structured, exchangeable spinning units.

29. An apparatus as in claim 28, wherein said spinning unit includes a refinement unit comprising at least one of a drafting unit or an opening roller.

30. An apparatus as in claim 28, wherein said spinning unit includes a spinning box that produces a thread according to one of a rotor spinning method, an air spinning method, a friction spinning method, or a false twist spinning method.

31. A textile machine as in claim 28, wherein each of said spinning units is driven by a corresponding drive unit having at least one motor.

32. A textile machine as in claim 31, wherein said at least one motor comprises a reluctance motor.

* * * * *